United States Patent [19]

Beuzart

[11] Patent Number: 4,580,342

[45] Date of Patent: Apr. 8, 1986

[54] CONTAINER OPENING DEVICE

[76] Inventor: Gilles Beuzart, 29 Allee de l'Hermitage, 33340 Le Raincy, 75009 Paris, France

[21] Appl. No.: 682,791

[22] Filed: Dec. 17, 1984

[51] Int. Cl.[4] ..... B67B 7/00; B65D 35/28

[52] U.S. Cl. ..... 30/2; 30/124; 222/81

[58] Field of Search ..... 30/2, 123, 124, 134, 30/289; 222/81

[56] References Cited

U.S. PATENT DOCUMENTS

| | | | |
|---|---|---|---|
| 1,785,599 | 12/1930 | Schmerler | 30/2 X |
| 2,615,239 | 10/1952 | Allen | 30/2 |
| 2,702,660 | 2/1955 | Donaldson | 30/2 X |
| 3,774,251 | 11/1973 | Pellman | 30/134 |
| 3,902,652 | 9/1975 | Malcolm | 222/81 |
| 4,291,461 | 9/1981 | Hansen | 30/2 |
| 4,360,970 | 11/1982 | Ostroski et al. | 30/2 |
| 4,514,902 | 5/1985 | Stewart | 30/2 |

*Primary Examiner*—Jimmy C. Peters

*Attorney, Agent, or Firm*—Knobbe, Martens, Olson & Bear

[57] ABSTRACT

The device includes a rigid frame for receiving and holding a non-rigid container adapted to the shape of the container; this removable frame is in combination with a cutter for clipping the container spout when it is unfolded; the cutting means is also used after the cutting operation to insure temporary sealing of the spout between liquid pouring operations.

6 Claims, 12 Drawing Figures

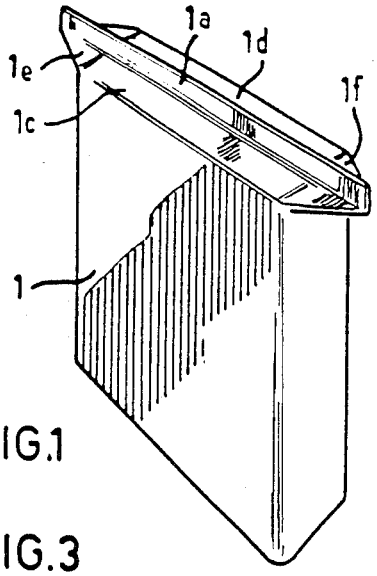
FIG.1
FIG.2
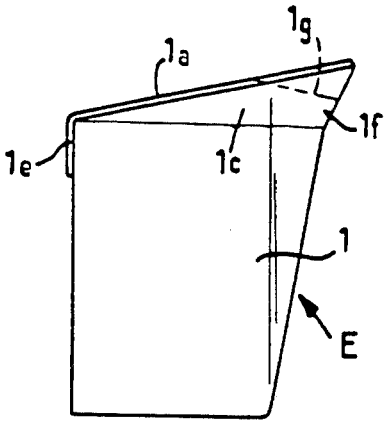
FIG.3
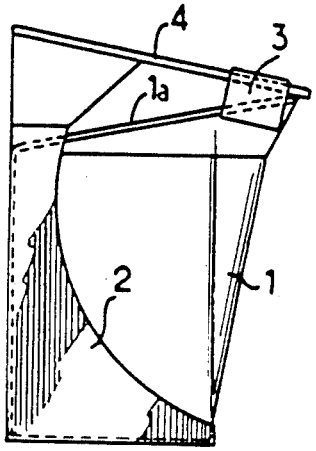
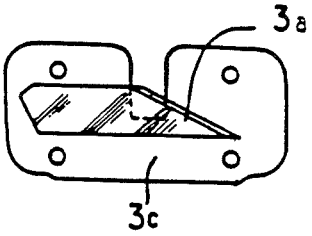
FIG.12
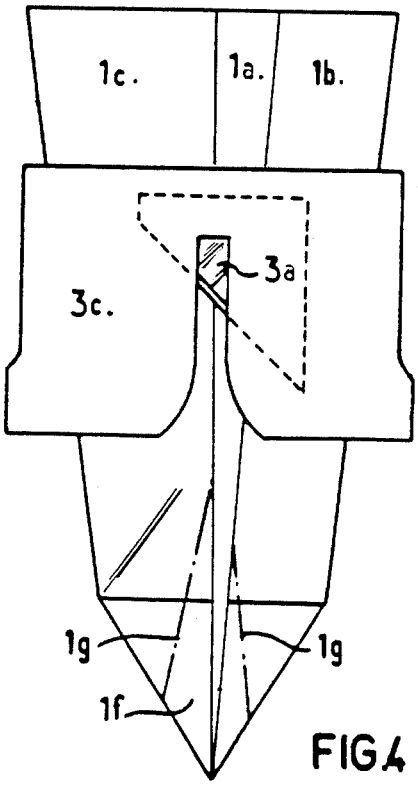
FIG.4

CONTAINER OPENING DEVICE

BACKGROUND OF THE INVENTION

The well-known method of packaging liquid products, such as milk, fruit juices, and others, is to use parallelepipedic leak-proof containers formed by folding and pasting a sheet of a non-rigid material, such as waterproofed cardboard.

The upper part of these parallelepipedic containers is made of the ridge obtained by pasting together the edge of the larger opposite surfaces, and by two small beaks or horns folded against the two smaller surfaces when storing the container.

A container such as these can be opened by clipping one of the beaks with scissors or any similar instrument, after this beak has been pulled up.

The users are well aware that, notwithstanding their indisputable advantages, these containers present significant drawbacks: they are often difficult to open; the hand pressure on the container sides for opening, handling, and pouring may cause accidental spilling through the clipped beak, and therefore a loss of product; the product may deteriorate by oxidization or may take a bad taste when stored in a refrigerator with strong smelling food (e.g., some processed meat, cantaloupe, etc.).

These disadvantages create, in fact, three problems related to the opening, handling and closing of the container between pourings.

Previous attempts to solve these problems were never quite complete nor perfect.

Such is the case of the West German patent DE-A-2932886 which describes some kind of elastic pincers used to provide the tearing of the beak, and also the reclosing of the container; but theoretically, the reclosing is problematic.

Anyhow, even with the use of this pincer, the container must still be held directly by hand for the opening, closing and pouring operations, which is the cause of the undesired gushing due to the pressure of the fingers.

The device disclosed by West German patent DE-A-3019745 is much better in the sense that a frame with a handle is provided to lodge the container; a cross-cutting device for clipping the tip and the pulled up beak is supported by a stirrup articulated on the frame.

Although this last patent seems to solve the problem of spilling liquid when handling and opening the container, it provides no solution for insuring an airtight closure of said container.

SUMMARY OF THE INVENTION

The present invention relates to a simple device which satisfactorily alleviates the above-mentioned three problems.

The device of the invention is characterized by the fact that it includes a stiff frame for receiving and holding a non-rigid container, adapted to the shape of the container; this removable frame, formed to fit the container, is combined with cutting means for clipping the spout when it is unfolded; these cutting means are suitably dimensioned and shaped so that they can also be used after the cutting operation to insure temporary sealing of the spout between pourings of the liquid.

According to a preferred approach, the airtight closing of the spout is obtained by bringing together the lips of the spout, and pinching them together under pressure.

DESCRIPTION OF THE DRAWINGS

Other features and advantages of the invention will be apparent from reading the following description and claims, set forth in conjunction with the accompanying drawings:

FIG. 1 is a perspective view of a typical container concerned by the invention;

FIG. 2 is a view of the same container with the beak pulled up;

FIG. 3 shows a first method of implementing the invention;

FIG. 4 is a top view of this first design;

FIGS. 11 and 12 are views of details.

DETAILED DESCRIPTION OF THE PREFERRED EMBODIMENT

Figure 5:
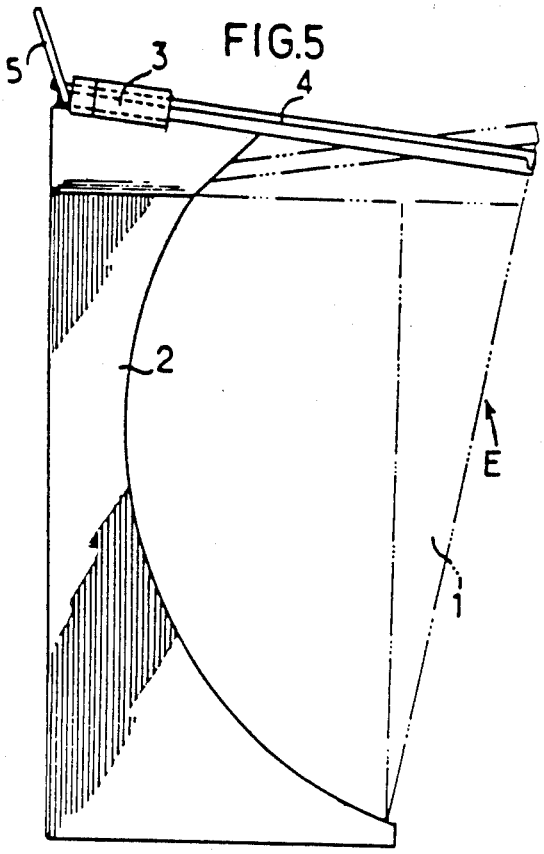
FIG. 5 shows a second method of implementation.
Figure 10:
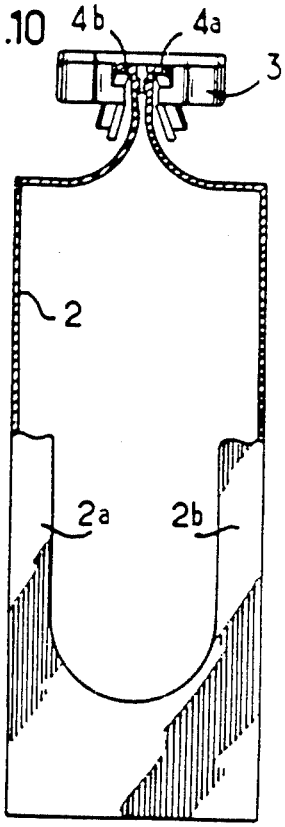
FIG. 10 is an inside view of the frame.

As shown in FIGS. 1 and 2, the typical parallelepipedic container of this invention is a prismatic tube 1 made from a sheet of waterproofed, grooved cardboard. After the container is filled, tube 1 is closed by pasting together into a ridge 1*a* the edges limiting the two half parts 1*c* and 1*d* of the top surface, and extending to the lateral beaks 1*e* and 1*f*. One of the beaks, for example 1*f* which will serve as the spout, is marked with a dotted line 1*g* to show the place where a manual cut is usually performed.

When the container is in storage, the beaks 1*e* and 1*f* are folded against the smaller sides of the parallelepiped, and the ridge 1*a* is turned down against the top surface. To open the container in the conventional manner, such as cutting with scissors along the dotted line 1*g*, the ridge 1*a* is turned up, and the beak 1*f* is pulled up in the position shown on FIG. 2. Since the other beak 1*e* remains folded, the ridge 1*a* assumes a position more or less slanted as the beak 1*f* is more or less pulled up.

According to this invention, the frame 2 (FIG. 3), shaped and dimensioned to house the container 1, is provided on top with a carriage-like cutting element 3 which can be moved in the vertical plane of the ridge 1*a* (in up position). The frame is sufficiently stiff or rigid to serve as a support structure to be gripped to lift the container. The cutting carriage can be a slider with a blade 3*a*, as shown on FIGS. 4 and 12. This slider or carriage could be a conventional device with wheel and circular blade, such as the type described in Belgium Pat. No. 679,031, or a shear-like element as in U.S. Pat. No. 2,263,353.

Whatever it may be, the cutting element must be able to move longitudinally in the plane of ridge 1*a*, from one beak (or near) to the other. For this purpose, slider 3 is supported by a guide 4 placed above the ridge 1*a* in such a manner that in the translation of the slider, the cutting element—either the above-mentioned blade 3*a* or another—penetrate the ridge 1*a* slantwise, as for example, along the dotted line 1*g*.

This result may be obtained by tilting the guide 4 on the horizontal plane, as illustrated in FIG. 3, in such a manner that preferably only the beak 1*f* will be cut.

According to the invention, a closing device is incorporated with the cutting element in order to insure re-closure of the beak after it has been open.

It is desirable to construct this guide 4 in two parts 4*a*-4*b*, jointed on top of each other as in a pincer.

Figure 6:
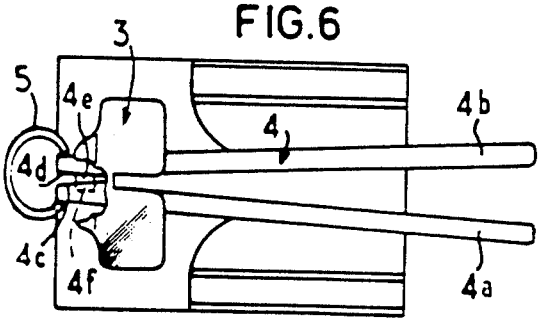
FIG. 6 is a top view of this second design.
Figure 7:
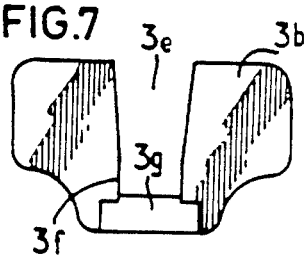
FIGS. 7, 8 and 9 are views of the slider body.
Figure 8:
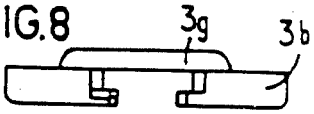

FIGS. 5 and 6 illustrate this design. The guide 4 is composed of two jaws 4*a* and 4*b* intended to clamp together the lips of the ridge 1*a*. They can pivot on a rotating axis 4*e*/4*f*, located near the part of the frame opposite the beak to be clipped, by means of two inside bevels facing each other, 4*c*-4*d*.

The axis of rotation is made of a stud 4*e* integral with 4*a*, which lodges in a larger housing 4*f* provided into 4*b*.

Each back part of jaws 4*a* and 4*b* features an outside bevel 4*a*1 and 4*b*1.

Each jaw has an inverted L-shaped section. The front end of jaw 4*a* has a superthickness 4*g*, as seen in FIG. 11.

As shown in FIGS. 7, 8, 9 and 12, the slider 3 is preferably constructed of two parts which are fastened to each other after insertion of the blade 3*a*: the body 3*b*, and the cover 3*c* (FIGS. 4 and 6).

The body 3*b* is designed not only to slide on jaws 4*a* and 4*b* of the pincer (for this purpose, the body features a groove 3*d* with an L section flared towards the front 3*e*, and with parallel sides towards the rear end 3*f* under the bridge 3*g*), but also to produce the opening-closing motion of these jaws.

Figure 11:
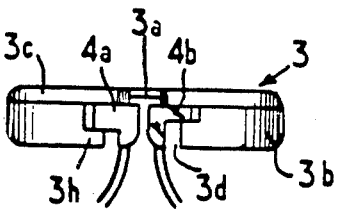
Figure 9:
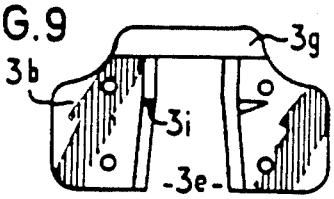

As seen in FIG. 11, the transversal L section of this groove 3*d* features (in the flared part and on one side only) a thinning down of the lip 3*h*. This partial reduction of the lip permits to provide an adequate inside abutment 3*i* which stops the superthickness 4*g* to limit the translation of the slider 3.

It is easy to understand that when the slider is in its farthest position, it rides the narrowest part of the jaws (because of the outside bevels) with a certain lateral clearance. Whereas when the slider moves forward in the opposite direction, its rectilinear portion 3*f* (the narrowest of the groove) which is barely wider than the pincers total width, closes the jaws together.

The forward motion of the slider, restrained by the jaws, has the effect of applying tension on the two separate parts 2*a*-2*b* which form the back of the frame, since each of these parts is integral with a jaw 4*a* or 4*b*, and that said jaws were originally shaped in the open position. Accessorily, the ring 5 which permits to hold the frame 2, and which is open, and which has each end inserted in a small cavity on the side of the jaws, contribute to their opening.

I claim:

1. Opening device for a parallelepipedic container made of a non-rigid material, having on one hand a projecting top ridge obtained by sealing together after fill up the two longitudinal lips limiting the two larger opposite lateral faces, and, on the other hand, two small beaks that fold against the smaller faces when the container is handled; said device featuring on one hand a removable frame suitably shaped and dimensioned to encompass the container, and, on the other hand, an opening element with a blade or any similar cutting part, and characterized by the fact that this opening element (3) moves longitudinally to cut a portion of the ridge (1*d*) and one of the beak (1*f*) in a slantwise direction (dotted line 1*g*) with respect to the position of said ridge when the beak (1*f*) is lifted at least up to the level of the container top surface (1*c*).

2. Device of claim 1 wherein the opening element (3) slides in the manner of a cursor on a support-guide (4) integral with frame (2).

3. Device of claim 2 wherein this guide consists of a pincer with two jaws (4*a*-4*b*) moving on top of each other on a virtual or real axis on the frame side, said jaws being placed on each side of the ridge that is to be clipped.

4. Device of claim 3 wherein the sliding of the slider-blade holder assembly (3) on the guide causes the jaws (4*a*-4*b*) to come together, and therefore re-shut the beak-spout (1*f*).

5. Device of claim 3 wherein each jaw (3*a*-4*b*) features an inside bevel (4*c*-4*d*) located beyond said axis opposite from the jaw portions which engage the spout, and also an outside bevel (4*a*1-4*b*1).

6. The device of claim 1 wherein the frame includes on its upper end a pair of elongated jaws which are attached to the rear of the frame and extend forwardly in cantilever fashion towards the container spout when the container is positioned within the frame, the frame being formed such that the forward ends of the jaws are inherently biased into an open position when the container spout is open.

* * * * *